US008919918B2

(12) United States Patent
Igawa et al.

(10) Patent No.: US 8,919,918 B2
(45) Date of Patent: Dec. 30, 2014

(54) INKJET PRINTING APPARATUS AND CLOGGED NOZZLE RECOVERING METHOD

(71) Applicant: Mimaki Engineering Co., Ltd., Tomi (JP)

(72) Inventors: Tomomi Igawa, Tomi (JP); Seiichi Yokoyama, Tomi (JP)

(73) Assignee: Mimaki Engineering Co., Ltd., Tomi (JP)

( * ) Notice: Subject to any disclaimer, the term of this patent is extended or adjusted under 35 U.S.C. 154(b) by 0 days.

(21) Appl. No.: 14/066,693

(22) Filed: Oct. 30, 2013

(65) Prior Publication Data

US 2014/0132664 A1 May 15, 2014

(30) Foreign Application Priority Data

Nov. 14, 2012 (JP) ..... 2012-250708

(51) Int. Cl.
*B41J 29/393* (2006.01)
*B41J 2/165* (2006.01)

(52) U.S. Cl.
CPC ..... *B41J 2/16532* (2013.01)
USPC ..... 347/30; 347/19; 347/29

(58) Field of Classification Search
CPC ..... B41J 29/38
USPC ..... 347/19, 29–33
See application file for complete search history.

(56) References Cited

U.S. PATENT DOCUMENTS

2014/0132665 A1* 5/2014 Igawa ..... 347/30

FOREIGN PATENT DOCUMENTS

JP 02-000525 A 1/1990

* cited by examiner

*Primary Examiner* — Jason Uhlenhake
(74) *Attorney, Agent, or Firm* — Park, Kim & Suh, LLC

(57) ABSTRACT

The present invention provides an inkjet printing apparatus in which aggregate or the like clogged in a nozzle is sucked to recover the clogged nozzle and provides a clogged nozzle recovering method. The inkjet printing apparatus in accordance with the present invention includes a cap which is structured to cover some of plural nozzles formed in a nozzle face of a head of an inkjet printer, a pressure sensor which acquires a pressure in an inside of the cap in a state that the some of the plural nozzles are covered by the cap, a suction means which sucks the inside of the cap with a pressure lower than a negative pressure at which a meniscus of a nozzle that is not covered with the cap is broken, and a nozzle recovery judgment means which judges recovery of a nozzle by comparing a reference pressure value, which is obtained when nozzles without being clogged are covered by the cap and sucked and is stored beforehand, with a pressure value which is outputted from the pressure sensor.

16 Claims, 10 Drawing Sheets

INKJET PRINTING APPARATUS AND CLOGGED NOZZLE RECOVERING METHOD

This application claims the benefit of Japanese Patent Application No. 2012-250708, filed on Nov. 14, 2012 in Japan, which is hereby incorporated by reference as if fully set forth herein.

FIELD OF THE INVENTION

The present invention relates to an inkjet printing apparatus in which aggregate or the like clogged in a nozzle is sucked to recover the clogged nozzle and relates to a clogged nozzle recovering method.

BACKGROUND ART

FIG. 10 is a structural view showing a cap unit which is used for recovering a conventional inkjet head. The cap unit 900 includes a cap 903 which is abutted with a nozzle face 902 where a plurality of nozzles 901 is formed, a belt member 904 which supports and moves the cap 903 and covers the nozzle face 902, and pulleys 905 and a motor (not shown) for moving the belt member 904. A tube 906 is connected with the cap 903 and the tube 906 is connected with a waste liquid tank (not shown).

In the cap unit 900, the belt member 904 is moved to a portion of the nozzles 901 where aggregate or the like is clogged and the cap 903 is located at the portion to suck the nozzle 901 through the cap 903. The belt member 904 is abutted with the nozzle face 902 so as to close the nozzles 901 which are not sucked.

CITATION LIST

Patent Literature

[PTL 1] Japanese Patent Laid-Open No. Hei 2-525

However, in the conventional cap unit 900, since the nozzle face 902 is closed by the belt member 904 during a process for recovering from clogging of the nozzle 901, there is a possibility that ink enters into a gap space between the belt member 904 and the nozzle face 902 to ooze out and a meniscus of the nozzle 901 is broken.

In view of the problem described above, an objective of the present invention is to recover a clogged nozzle without breaking a meniscus of a nozzle.

SUMMARY OF INVENTION

Solution to Problem

An inkjet printing apparatus in accordance with the present invention includes a cap which is structured to cover some of plural nozzles formed in a nozzle face of a head of an inkjet printer, a pressure sensor which acquires a pressure in an inside of the cap in a state that the some of the plural nozzles are covered by the cap, a suction means which sucks the inside of the cap with a pressure lower than a negative pressure at which a meniscus of a nozzle that is not covered with the cap is broken, and a nozzle recovery judgment means which judges recovery of a nozzle by comparing a reference pressure value, which is obtained when nozzles without being clogged are covered by the cap and sucked and is stored beforehand, with a pressure value which is outputted from the pressure sensor.

In the present invention, an inside of the cap is sucked with a pressure lower than a negative pressure at which a meniscus is broken, and an output value from the pressure sensor which is its suction result is compared with a reference pressure value which is obtained when the nozzle without being clogged is sucked and is stored beforehand and thereby recovery from clogging of a nozzle is judged. Therefore, the nozzle can be recovered without breaking a meniscus of a nozzle and the recovery can be judged.

Further, the inkjet printing apparatus may include a meniscus breakage pressure acquiring means which acquires a position and a number of clogged nozzles among all nozzles, and acquires a position and a number of the clogged nozzles which are not covered with the cap and, based on the positions and the numbers, acquires a negative pressure at which a meniscus of a nozzle without being clogged which is not covered with the cap is broken.

Further, in the inkjet printing apparatus, the suction means may suck the inside of the cap with a first pressure lower than the negative pressure at which the meniscus is broken and, after that, suck the inside of the cap with a second pressure that is a negative pressure higher than the first pressure.

Further, the inkjet printing apparatus may include a leak judgment means which judges leakage of the cap by comparing a pressure value which is a threshold value stored beforehand for leak judgment with a pressure value which is outputted from the pressure sensor.

Next, a clogged nozzle recovering method in accordance with the present invention include a covering step in which some of plural nozzles formed in a nozzle face of a head of an inkjet printer is covered by a cap having a pressure sensor, a suction step in which an inside of the cap is sucked with a pressure lower than a negative pressure at which a meniscus of a nozzle that is not covered with the cap is broken, and a nozzle recovery judgment step in which recovery of a nozzle is judged by comparing a reference pressure value, which is obtained when a nozzle without being clogged is covered by the cap and sucked and is stored beforehand, with a pressure value which is outputted from the pressure sensor.

Further, the clogged nozzle recovering method may include a meniscus breakage pressure acquiring step in which a position and a number of clogged nozzles among all nozzles are acquired, and a position and a number of the clogged nozzles which are not covered with the cap are acquired and, based on the positions and the numbers, a negative pressure at which a meniscus of a nozzle without being clogged which is not covered with the cap is broken is acquired.

Further, in the suction step in the clogged nozzle recovering method, it may be performed that the inside of the cap is sucked with a first pressure lower than the negative pressure at which the meniscus is broken and, after that, the inside of the cap is sucked with a second pressure that is a negative pressure higher than the first pressure.

Further, the clogged nozzle recovering method may include a leak judgment step in which leakage of the cap is judged by comparing a pressure value which is a threshold value stored beforehand for leak judgment with a pressure value which is outputted from the pressure sensor.

Effects of the Invention

According to the present invention, a clogged nozzle can be recovered without breaking a meniscus of a nozzle. Further, recovery of a nozzle can be also judged.

DESCRIPTION OF EMBODIMENTS

First Embodiment

Figure 1:
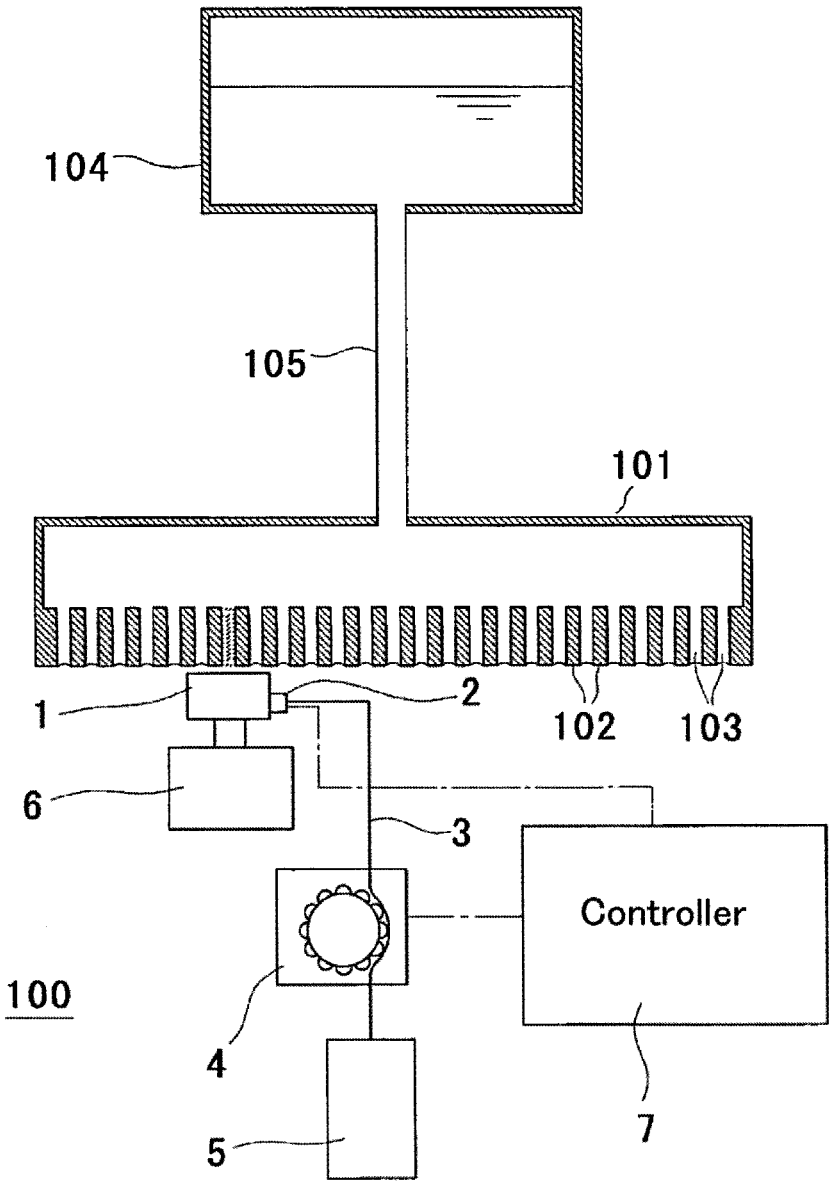
FIG. 1 is a structural view showing a nozzle suction device in an inkjet printer in accordance with a first embodiment of the present invention.

FIG. 1 is a structural view showing a nozzle suction device in an ink jet printer in accordance with a first embodiment of the present invention. The nozzle suction device 100 includes a cap 1 which is stuck to a nozzle face 102 of a head 101 of an inkjet printer to suck ink in an inside of the nozzle, a tube 3 connected with the cap 1, a pressure sensor 2 which is connected with a downstream side of the cap 1 for acquiring a pressure in an inside of the cap 1, a pump 4 connected with the tube 3, a waste liquid tank 5 connected with a downstream side of the pump 4 through the tube 3, an actuator 6 such as an air cylinder which moves the cap 1 up and down, a controller 7 which drives and controls the actuator 6 and the pump 4. The cap 1 is formed of a box-shaped body and an end edge on its suction side is structured of sealing material such as rubber which is capable of maintaining airtight property with the nozzle face 102. Further, the cap 1 covers some of plural nozzles 103 which are formed in the nozzle face 102. In this embodiment, the nozzle face 102 is divided into plural regions and the cap 1 covers some of the plural nozzles 103. A size of the cap 1 is determined depending on the number of the nozzles and the size of the nozzle face 102.

The nozzle face 102 of the head 101 is formed with a large number of the nozzles 103. In the first embodiment, for convenience of description, the nozzle face 102 is formed with the nozzles 103 of vertically 4 lines and laterally 25 rows as an arrangement example of the nozzles 103. Further, the head 101 is connected with a sub-tank 104 through the tube 105. The sub-tank 104 is provided in a carriage (not shown), which holds the head 101, and functions as a damper which suppresses pressure fluctuation. Further, the inside of the sub-tank 104 is maintained at a constant negative pressure by a pump (not shown) so as to form a predetermined meniscus at an end edge of the nozzle 103.

Figure 2:
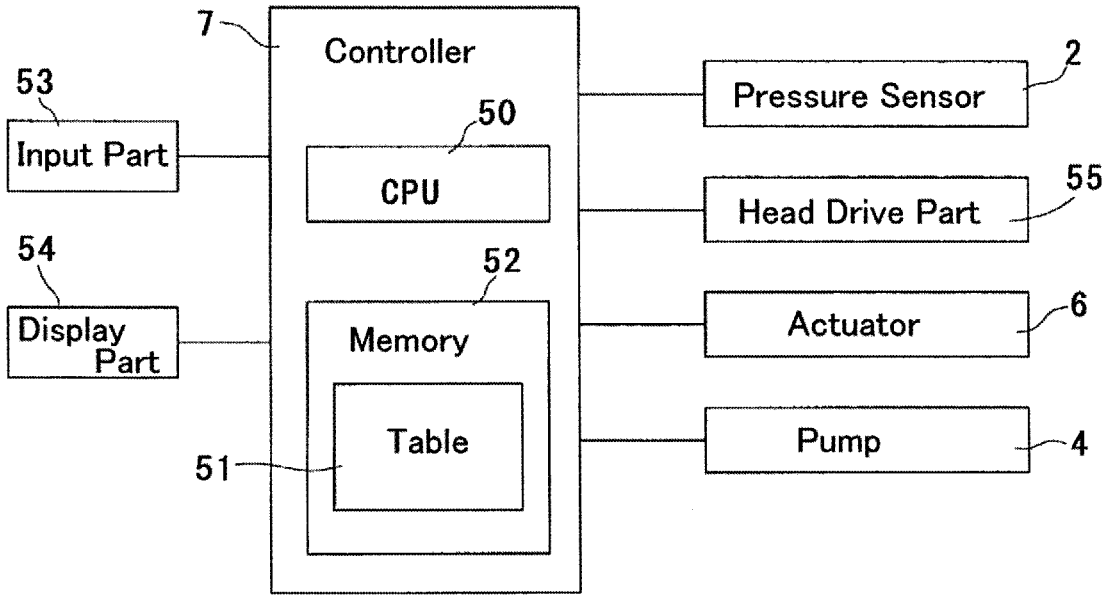
FIG. 2 is a block diagram showing the nozzle suction device in FIG. 1.

FIG. 2 is a block diagram showing the nozzle suction device in FIG. 1. The controller 7 includes a CPU (Central Processing Unit) 50 which performs arithmetic processing and a memory 52 which stores programs for executing processes described below and a table 51 in which information such as pressure values described below is stored for each number of the nozzles. The controller 7 is connected with an input part 53 such as an operation panel and a display part 54 such as a liquid crystal panel. Further, the pressure sensor 2, a head drive part 55 for driving the head 101, the actuator 6 and the pump 4 are electrically connected with the controller 7. The controller 7 includes driver circuits for the actuator 6 and the pump 4.

In accordance with an embodiment of the present invention, programs which instruct the controller 7 may be stored in a memory means, an outside computer (including a resource form built in Internet space) and the like which are capable of being connected with the inkjet printer. Further, a value which is a threshold value for judgment described below is obtained on the basis of experiments or the like and is stored in the table 51.

[Detection of Clogged Nozzle Number and Position]

Figure 3:
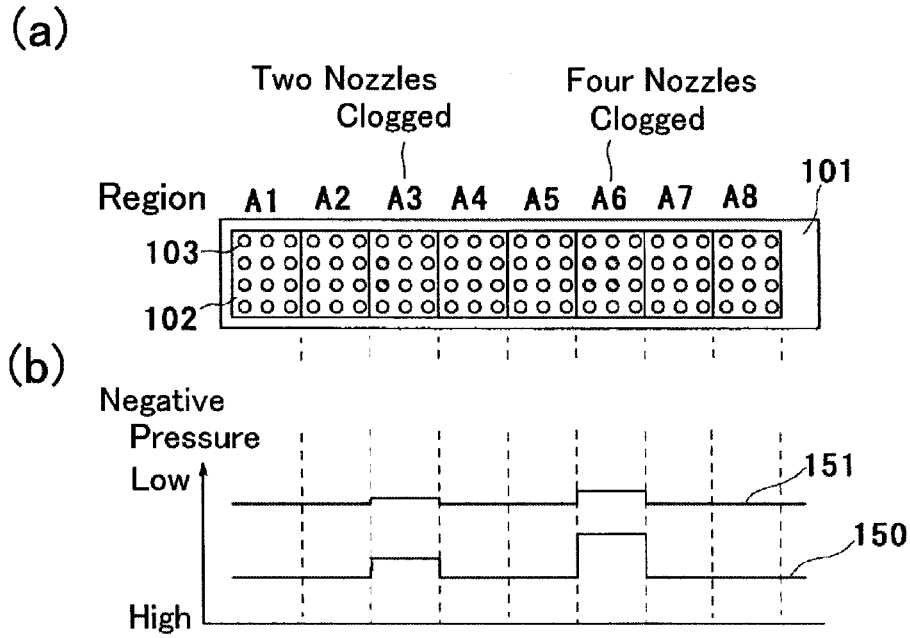
FIGS. 3(*a*) and 3(*b*) are explanatory views showing a process in which the number of clogged nozzles is detected.
Figure 4:
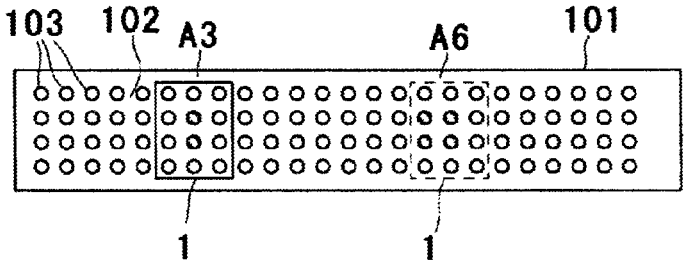
FIG. 4 is an explanatory view showing a process in which the number of clogged nozzles is detected.
Figure 5:
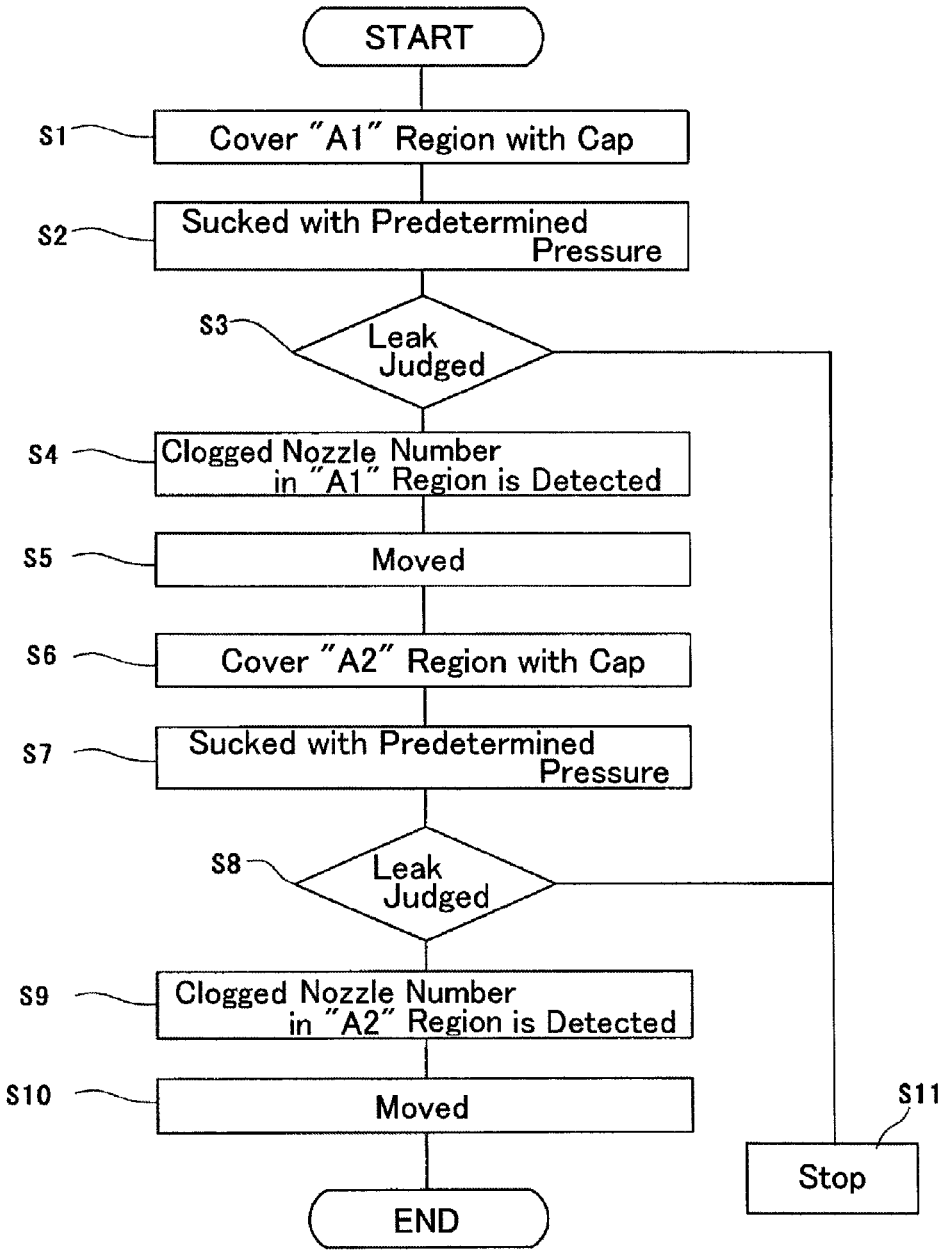
FIG. 5 is a flow chart showing a process in which the number of clogged nozzles is detected.

FIGS. 3(*a*) and 3(*b*) and FIG. 4 are explanatory views showing a process in which the number of clogged nozzles is detected. FIG. 5 is a flow chart showing a process in which the number of clogged nozzles is detected. An end part on an opening side of the cap 1 is formed in a rectangular shape in a plan view, and the number of the nozzles which are capable of being covered by the cap 1 is, when a longer direction of the nozzle face 102 is a lateral direction, four nozzles in the vertical direction and three nozzles in the lateral direction, i.e., totaled 12 nozzles.

In order to detect the number of clogged nozzles, the carriage is moved by the head drive part 55 of the inkjet printer to locate the "A1" region of the head 101 above the cap 1 and then the cap 1 is moved upward by the actuator 6 so as to cover the "A1" region (step S1). The "A1" region corresponds to a portion where four nozzles 103 in the vertical direction and three nozzles 103 in the lateral direction are located from a left edge in the drawing of the nozzle face 102. A rectangular end edge of the cap 1 abutted with the nozzle face 102 is tightly contacted with a flat face portion of the nozzle face 102 to separate the inside of the cap from the outside.

In this state, the pump 4 is driven to suck the inside of the cap 1 (step S2). A pressure in the inside of the cap 1 is monitored by the pressure sensor 2 and it is judged whether leakage occurs in the cap 1 or not based on an output value from the pressure sensor 2 (step S3). In this case, the pressure used for leak judgment is set higher than a pressure used for judging the number of the clogged nozzles 103 (negative pressure is set lower). In other words, sucking is performed with a suction force smaller than a suction force at the time of nozzle suction, that is, the negative pressure in the inside of the cap 1 is lowered to a pressure so that ink is not sucked from the nozzle 103 and influence of an outflow of ink from the nozzle 103 is eliminated. In this manner, a leak judgment can be independently performed of judgment of the number of clogged nozzles.

In a case that leakage does not occur in the cap 1, as shown in FIG. 3(*b*), a leak judgment reference pressure value 150 is detected by the pressure sensor 2. The leak judgment reference pressure value 150 is a pressure value in the inside of the cap 1 at the time of sucking with a suction force when leakage does not occur and is acquired experimentally beforehand. The leak judgment reference pressure value 150 is determined depending on a shape of each nozzle 103 and ink characteristics. For example, in the "A1" region, a pressure value detected by the pressure sensor 2 when leakage does not occur is substantially the same as the leak judgment reference pressure value 150.

On the other hand, when leakage occurs in the cap 1, as shown in FIG. 3(*b*), the cap 1 is unable to be sucked to the leak judgment reference pressure value 150. For example, the pressure value 151 of negative pressure detected in the "A1" region is lower than the leak judgment reference pressure value 150 due to entering of air from the outside. In this case, it is judged that leakage has occurred in the cap 1 and detection of the number of clogged nozzles 103 is stopped.

In addition, in the "A1" region, the number of clogged nozzles 103 is detected (step S4). A pressure used for detecting the number of clogged nozzles is a negative pressure which is higher than the leak judgment reference pressure value 150 but is lower than a negative pressure for performing nozzle recovery described below. In other words, since it is sufficient to distinguish clogged nozzles 103 through which ink does not flow, the nozzle is sucked with a pressure which is enough to flow out ink from the nozzle 103. The controller 7 sucks the inside of the cap 1 to acquire an output value of the pressure sensor 2. The controller 7 holds reference data of pressure values for each number of the nozzles in the table 51 and a pressure value which is actually detected is compared with the reference data to determine the number of the clogged nozzles 103 for each region. In this example, there is no clogged nozzles 103 in the "A1" region. Therefore, the reference data and an acquired actual pressure value are substantially the same as each other.

Next, when the detection in the "A1" region is finished, the cap 1 is moved downward by the actuator 6 and the carriage is moved so that an "A2" region of the head 101 is located above the cap 1 (step S5). Then, the cap 1 is moved upward by the actuator 6 to cover the "A2" region (steps S6 and S7). Next, also in the "A2" region, leakage and the number of clogged nozzles 103 are judged based on the similar processing to the "A1" region (steps S8 and S9). In this example, it is determined that there is no clogged nozzles 103 also in the "A2" region.

Next, when the detection in the "A2" region is finished, the cap 1 is moved downward by the actuator 6 and the carriage is moved so that an "A3" region of the head 101 is located above the cap 1 and then, the cap 1 is moved upward by the actuator 6 to cover the "A3" region (step S10, succeeding steps are repeatedly performed in the flow chart and thus not shown). Next, similar judgment processing is executed also for the "A3" region. Detection of leakage is similarly executed as described above. When leakage does not occur, the number of clogged nozzles 103 is judged. In the "A3" region, it is assumed that there are two clogged nozzles 103. When two nozzles 103 are clogged, since ink is sucked from remaining ten nozzles 103 and thus, as shown in FIG. 3(*b*), the negative pressure in the inside of the cap 1 becomes higher. The controller 7 compares a pressure value actually acquired and the reference data with each other and the number of clogged nozzles 103 is determined to be two.

Next, when the detection in the "A3" region is finished, the cap 1 is moved downward by the actuator 6 and the carriage is moved so that the "A4" region of the head 101 is located above the cap 1 and then, the cap 1 is moved upward by the actuator 6 to cover the "A4" region. And, also in the "A4" region, leakage and the number of clogged nozzles 103 are judged based on the similar processing to the "A1" through "A3" regions. In this example, it is determined that there is no clogged nozzles 103 also in the "A4" region. Next, similar processing is also executed for the "A5" region.

Next, when the detection in the "A5" region is finished, the cap 1 is moved downward by the actuator 6 and the carriage is moved so that the "A6" region of the head 101 is located above the cap 1 and then, the cap 1 is moved upward by the actuator 6 to cover the "A6" region. Next, similar judgment processing is also executed for the "A6" region. Detection of leakage is similarly executed as described above. When leakage does not occur, the number of clogged nozzles 103 is judged. In the "A6" region, it is assumed that four nozzles 103 are clogged. When four nozzles 103 are clogged, since ink is sucked from remaining eight nozzles 103 and thus, as shown in FIG. 3(*b*), the negative pressure in the inside of the cap 1 becomes higher. The controller 7 compares a pressure value actually acquired and the reference data with each other and the number of the clogged nozzles 103 is determined to be four.

Next, when detection in the "A6" region is finished, the "A7" region is covered with the cap 1. And, also in the "A7" region, leakage and clogging of the nozzles 103 are judged based on the similar processing to the "A6" region. In this example, it is determined that there is no clogged nozzles 103 in the "A7" region. Similar processing is also executed for the "A8" region.

In this manner, leakage and the number of clogged nozzles in each region are judged while the cap 1 and the nozzle face 102 are relatively moved to each other over respective regions. Positions of the clogged nozzles 103 are acquired by the region unit. The judgment results are stored in a location (memory 52 or the like) which is capable of being read from the controller 7.

In a case that judgment of the number of clogged nozzles is stopped due to leakage, the number of clogged nozzles may be judged by another means. For example, clogged nozzles 103 may be judged by printing a check pattern for the nozzles 103 or may be judged by taking an image of the nozzles 103 with a camera.

[Recovery of Nozzle]

Figure 6:
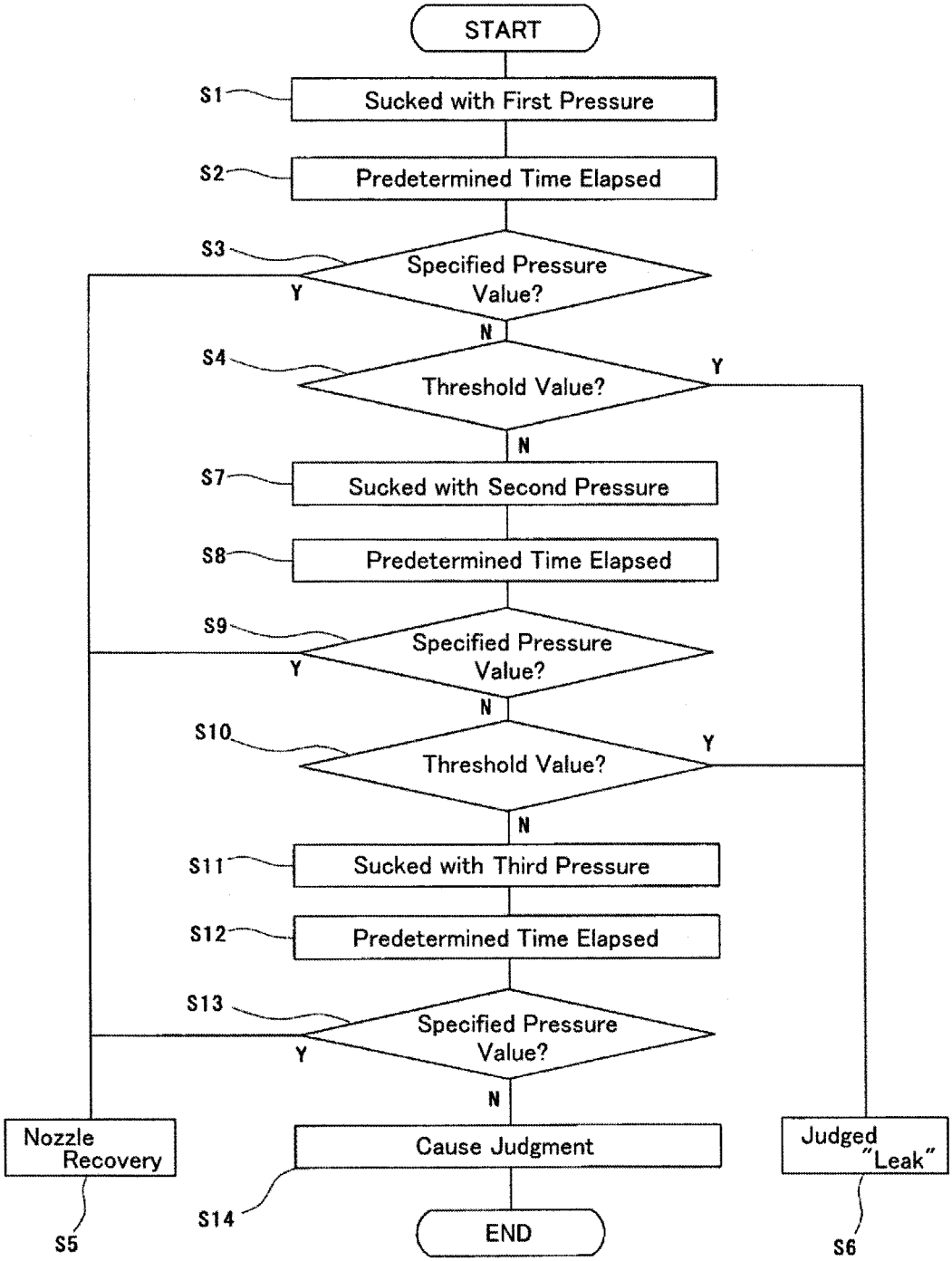
FIG. 6 is a flow chart showing a process in which leak judgment and recovery judgment from clogging of a nozzle are performed.
Figure 7:
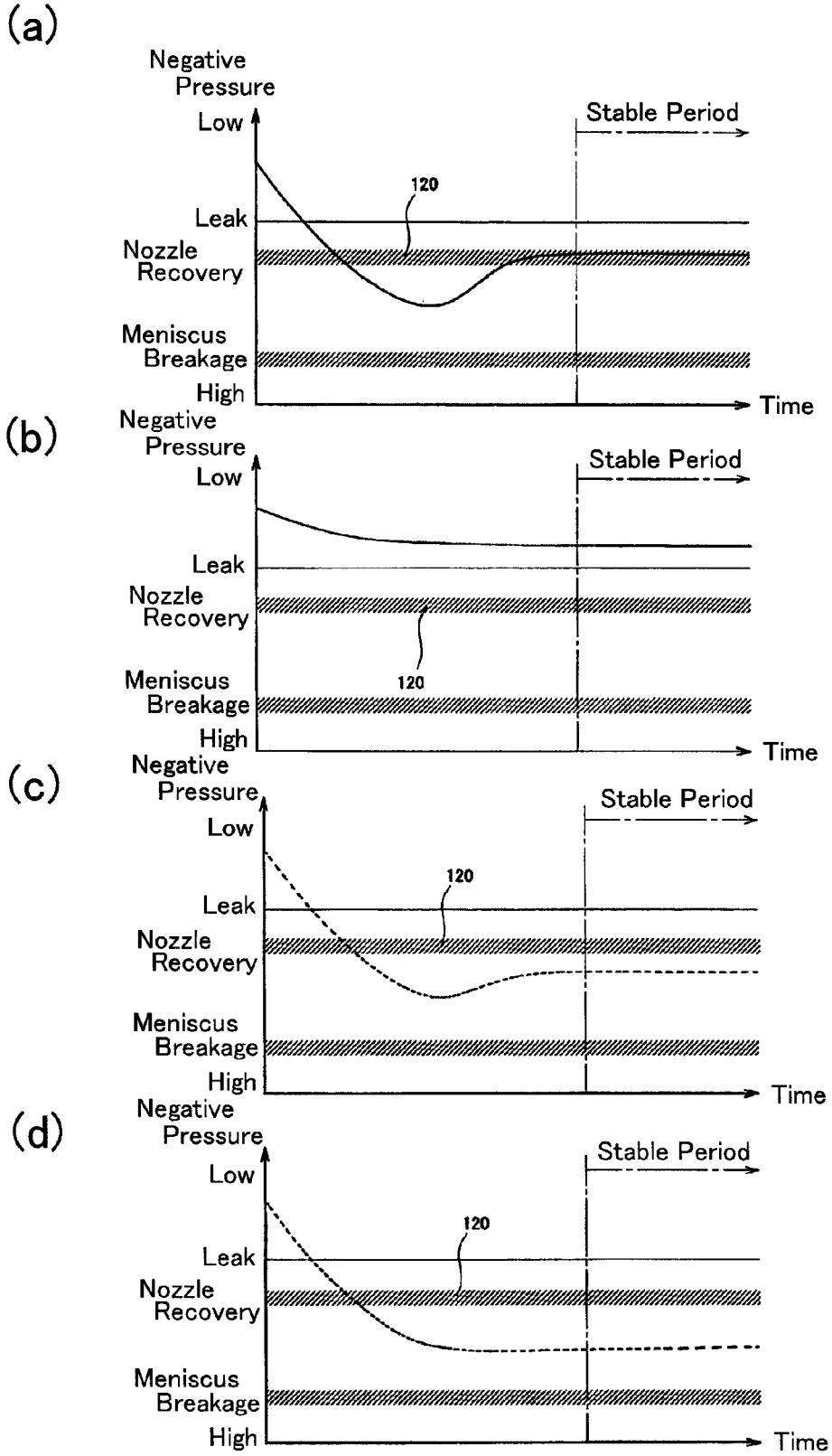
FIGS. 7(*a*) through 7(*d*) are graphs showing a variation of a pressure in an inside of a cap.

FIG. 6 is a flow chart showing a process in which a leak judgment and a recovery judgment of a nozzle are performed. FIGS. 7(*a*) through 9(*d*) are graphs showing a variation of a pressure in the inside of the cap.

First, the cap 1 is located in the "A3" region where clogged nozzles are detected by the above-mentioned process for judgment of clogged nozzle and the "A3" region is covered with the cap 1. The pump 4 is driven in a state that the "A3" region is covered with the cap 1 and the inside of the cap 1 is sucked while monitored by the pressure sensor 2 (step S1). In this case, when the inside of the cap 1 is excessively sucked, since the nozzles 103 in other regions are not covered by the cap 1 and are opened, the inside of the head 101 is sucked more than a specified value and the meniscus of the nozzle 103 in the other regions is broken. A pressure that a meniscus of a nozzle 103 in the other region is broken is determined by the number of the nozzles 103 in the other region and the number of clogged nozzles 103 among the nozzles 103 in the other region. Specifically, the pressure is obtained by multiplying a limit pressure reaching the breakage of a meniscus per a nozzle by the number of the nozzles 103 without being clogged. Therefore, the limit pressure for the breakage of the meniscus is different for respective regions.

The first pressure is set to be a pressure having a sufficient margin so as not to occur breakage of a meniscus. In other words, the inside of the cap 1 is sucked with a negative pressure which is considerably lower than the limit pressure occurring the breakage of a meniscus.

When the inside of the cap 1 is sucked with the first pressure, since two nozzles 103 are clogged, as shown in FIG. 7(*a*), a pressure in the inside of the cap 1 gradually goes down from the time of start of suction. And, in a case that clogging of the nozzles 103 is eliminated by suction and the nozzles 103 are normally recovered, the negative pressure in the inside of the cap 1 begins to lower and, after that, the negative pressure is stabilized to the reference pressure value 120. The reference pressure value 120 is a pressure value which is required to suck ink from all nozzles 103 in the inside of the cap 1. A certain time period from the start of suction is required for suction itself and for gradually recovering the clogging of the nozzles 103 and thus a judgment of recovery of the nozzle 103 is determined based on a pressure value in a stable period after a predetermined time period has elapsed (steps S2 and S3). When a pressure value in the stable period is substantially the same as the reference pressure value 120, it is determined that all the nozzles 103 are recovered (step S5). The stable period should be minimized because ink flows into the waste liquid tank 5 and is consumed uselessly.

On the other hand, when leakage occurs, as shown in FIG. 7(*b*), air flows into the cap 1 and thus a negative pressure in the inside of the cap 1 hardly becomes higher (step S4). A threshold value for leak judgment is previously set by acquiring data from experimental results of a pressure in the inside of the cap 1 when leakage occurs and, in a case that a negative pressure in the inside of the cap 1 does not become higher than the threshold value, it is determined that leakage has occurred (step S6). In a case that leakage occurs, since air leaks from the outside from the time of start of suction, insufficient pressure is detected from the beginning of suction.

In a case that only some nozzles 103 are recovered, as shown in FIG. 7(*c*), the negative pressure in the inside of the cap 1 is not lowered to the reference pressure value 120. When all the nozzles 103 are not recovered, as shown in FIG. 7(*d*), a flat characteristic maintaining the pressure value is detected after start of suction.

Figure 8:
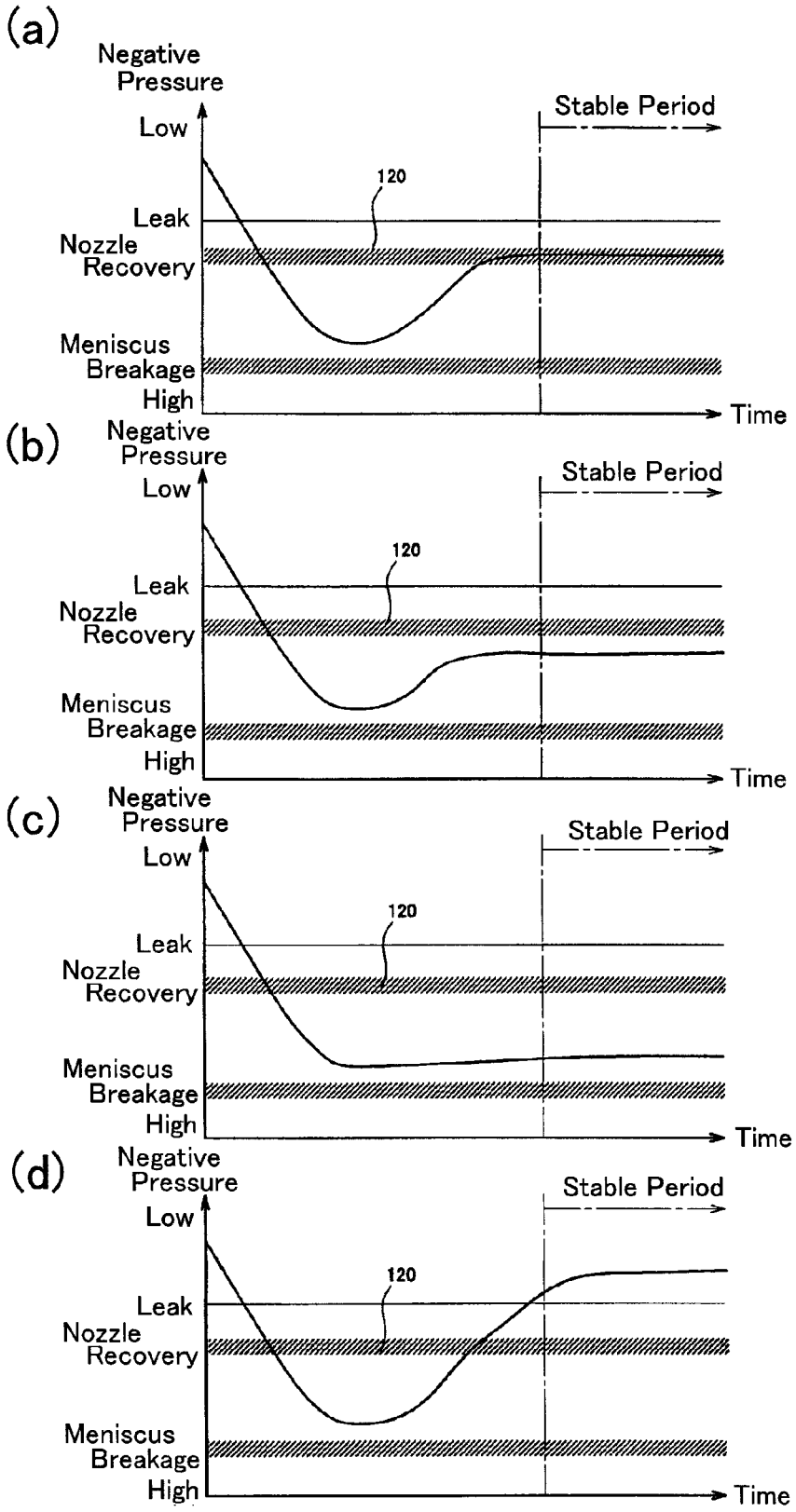
FIGS. 8(*a*) through 8(*d*) are graphs showing a variation of a pressure in an inside of a cap.

Next, in a case that the nozzles 103 are not recovered by the first pressure, the inside of the cap 1 is sucked with a second pressure (step S7). The second pressure is set to be a negative pressure higher than the first pressure in a range of the limit pressure that the meniscus is not broken. A case that all the nozzles 103 are not recovered will be described below. As shown in FIG. 8(*a*), when the inside of the cap 1 is sucked with the second pressure, since two nozzles 103 are clogged, the negative pressure in the inside of the cap 1 goes down gradually from the time of start of suction. When clogging of the nozzles 103 is eliminated by the suction and the nozzles 103 are recovered normally, the negative pressure in the inside of the cap 1 is lowered and, after that, the negative pressure is stabilized to the reference pressure value 120. In a case that the pressure in the stable period is smaller than the reference pressure value 120, it is determined that all nozzles 103 are recovered (steps S8, S9 and S5).

On the other hand, in a case that only one of two nozzles 103 is recovered, as shown in FIG. 8(*b*), the negative pressure in the stable period is higher than the reference pressure value 120. When two nozzles 103 are not recovered, as shown in FIG. 8(*c*), the pressure becomes flat in the stable period after suction and is maintained. Further, in a case that leakage occurs by applying the second pressure although the meniscus is not broken, the negative pressure in the inside of the cap 1 is rapidly lowered and becomes stable at a low negative pressure value as shown in FIG. 8(*d*). In a case that the pressure exceeds a threshold value for leak judgment (step S10), it is determined that leakage has occurred (step S6).

Next, in a case that all the nozzles 103 are not recovered, the inside of the cap 1 is sucked with a third pressure (step S11) and similar judgments described above are performed. When sucked in the vicinity of the limit pressure where the meniscus may be broken, the possibility that the meniscus is broken is increased but, breakage of the meniscus is actually affected by various conditions and thus the meniscus is not necessarily broken. Therefore, it is effective that suction is performed in the vicinity of the limit pressure.

Figure 9:
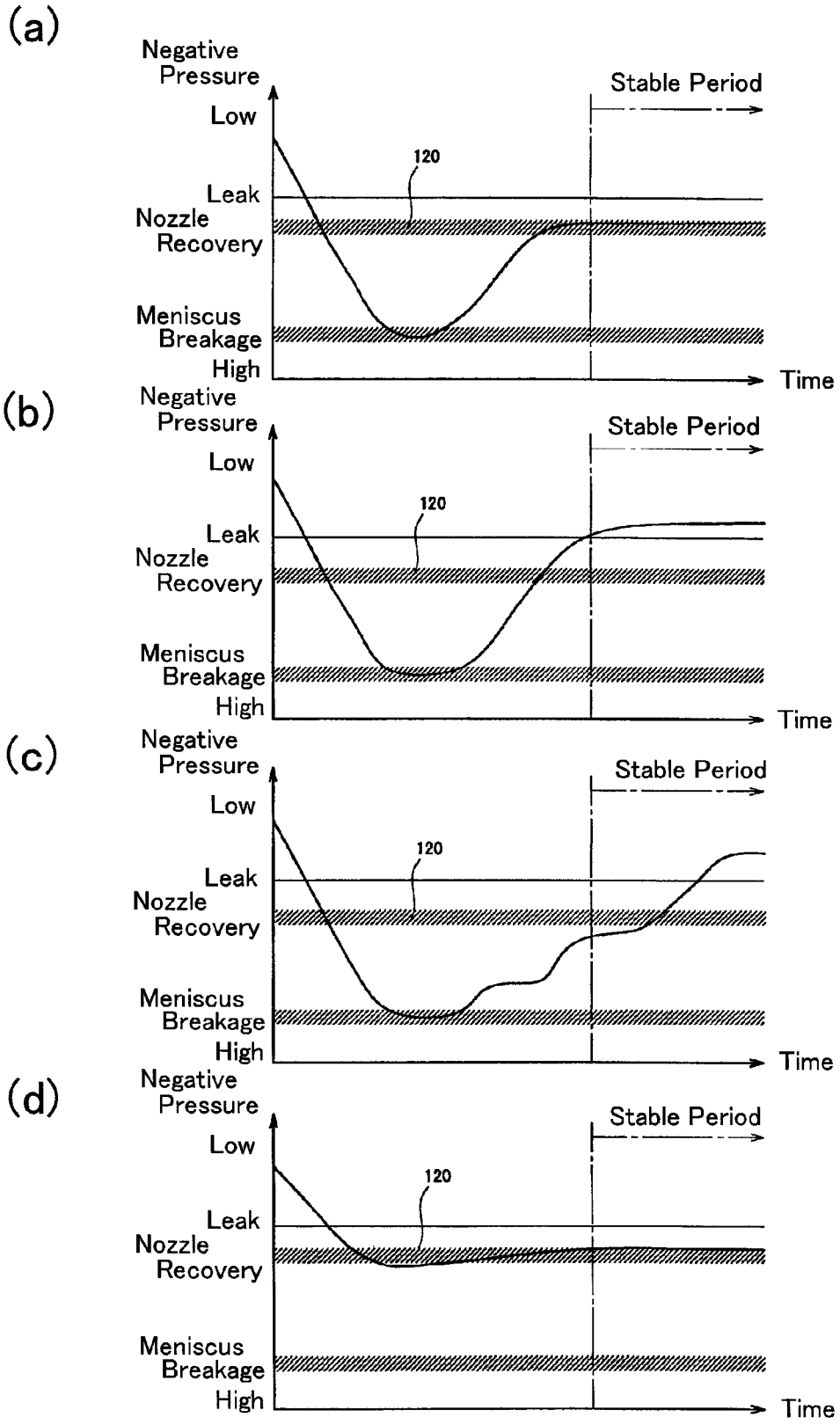
FIGS. 9(*a*) through 9(*d*) are graphs showing a variation of a pressure in an inside of a cap.
Figure 10:
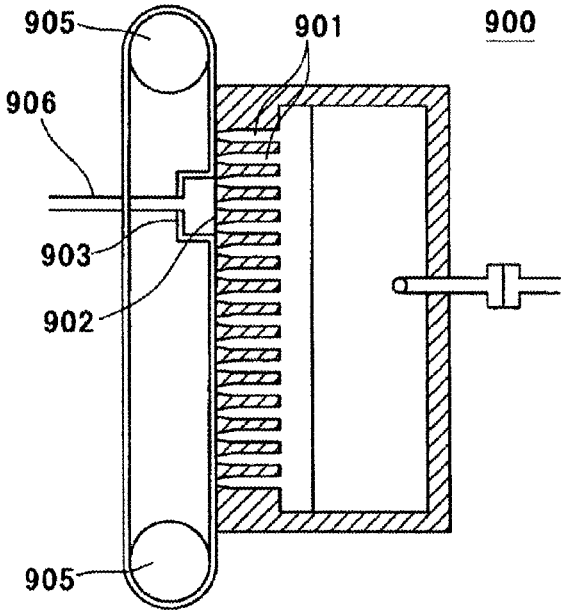
FIG. 10 is a structural view showing a cap unit which is used for recovering a conventional inkjet head.

As shown in FIG. 9(*a*), in a case that the inside of the cap 1 is sucked with the third pressure, when a pressure value in the inside of the cap 1 becomes substantially the same as the reference pressure value 120, it is determined that all the nozzles 103 are recovered (steps S12, S13 and S5). When some of the nozzles 103 are recovered, a flat output value is obtained with a pressure lower than the reference pressure value 120 (not shown). In other cases, for example, it is preferable that the cause is determined as follows (step S14).

FIG. 9(*b*) shows a variation of a pressure when the meniscus is broken. When the meniscus in a region other than the sucked region is broken, since air enters into the head 101 from the nozzle 103, a negative pressure in the inside of the cap 1 is lowered rapidly. In this case, it is not recognized whether breakage of the meniscus occurs or leakage occurs and thus it is judged depending on a pressure variation before a stable period (step S14). First, in a case that a negative pressure is low from start of suction, it is determined as a leak (step S6). Next, in a case that a pressure value becomes smaller than the threshold value for leak after start of suction, it is required to determine whether the cause is leakage or the breakage of the meniscus. The breakage of a meniscus is not necessarily occurred simultaneously in all the nozzles 103 but, once leakage occurs, a large amount of air is entered into the inside of the cap 1 and thus, as shown in FIG. 9(*b*), a feature is appeared on a rising angle from the peak of a pressure value. Therefore, a case that rising is swift is determined as a leak. Since breakage of a meniscus is considered to successively occur by a nozzle unit, as shown in FIG. 9(*c*), rising of the pressure is slow or unstable and thereby it is determined that the meniscus is broken.

In a case of a leak, since the head 101 is not provided with a critical problem, it is preferable that the cap 1 is exchanged and processing for the nozzle recovery is performed. On the other hand, in a case that a meniscus is broken, since clogging of the nozzle 103 cannot be recovered by suction through the cap 1, it is preferable that the head 101 is exchanged or the head 101 is detached and washed.

In a case that either breakage of a meniscus or nozzle recovery is to be judged, when the nozzles 103 are recovered, the reference pressure value 120 based on the number of the nozzles should be outputted and thus, when the outputted value is within a range of a value comprised of the reference pressure value 120 and a certain error, it is determined as recovery of the nozzle 103 and, when except the range, it is determined as breakage of a meniscus.

Finally, when nozzle recovery is to be checked, the corresponding region is covered with the cap 1 and is sucked with the reference pressure value 120. In this case, as shown in FIG. 9(*d*), the negative pressure in the inside of the cap 1 does not become higher than the reference pressure value 120 of the nozzle recovery and becomes stable.

After recovery of the nozzles 103 is performed in the "A3" region as described above, the cap 1 is relatively moved to the "A6" region where the nozzles 103 are clogged and the "A6" region is covered with the cap 1 and then recovery of the nozzles 103 is performed according to the above-mentioned similar procedure.

As described above, according to the nozzle suction device 100 in accordance with the present invention, the nozzles 103 are recovered without breaking a meniscus. Further, since a leak of the cap 1 can be judged, an error judgment is prevented in a recovery operation of the nozzle 103.

REFERENCE SIGNS LIST

100 nozzle suction device
101 head
103 nozzle
104 sub-tank
1 cap

2 pressure sensor
4 pump
5 waste liquid tank
6 actuator
7 controller

What is claimed is:

1. An inkjet printing apparatus comprising:

a cap which is structured to cover some of plural nozzles formed in a nozzle face of a head of an inkjet printer;

a pressure sensor which acquires a pressure in an inside of the cap in a state that the some of the plural nozzles are covered by the cap;

a suction means which sucks the inside of the cap with a pressure lower than a negative pressure at which a meniscus of a nozzle that is not covered with the cap is broken; and a nozzle recovery judgment means which judges recovery of a nozzle by comparing a reference pressure value, which is obtained when nozzles without being clogged are covered by the cap and sucked and is stored beforehand, with a pressure value which is outputted from the pressure sensor.

2. The inkjet printing apparatus according to claim 1, further comprising a meniscus breakage pressure acquiring means which acquires a position and a number of clogged nozzles among all nozzles, and acquires a position and a number of the clogged nozzles which are not covered with the cap and, based on the positions and the numbers, acquires a negative pressure at which a meniscus of a nozzle without being clogged which is not covered with the cap is broken.

3. The inkjet printing apparatus according to claim 2, wherein the suction means sucks the inside of the cap with a first pressure lower than the negative pressure at which the meniscus is broken and, after that, sucks the inside of the cap with a second pressure that is a negative pressure higher than the first pressure.

4. The inkjet printing apparatus according to claim 3, further comprising a leak judgment means which judges leakage of the cap by comparing a pressure value which is a threshold value stored beforehand for leak judgment with a pressure value which is outputted from the pressure sensor.

5. The inkjet printing apparatus according to claim 2, further comprising a leak judgment means which judges leakage of the cap by comparing a pressure value which is a threshold value stored beforehand for leak judgment with a pressure value which is outputted from the pressure sensor.

6. The inkjet printing apparatus according to claim 1, wherein the suction means sucks the inside of the cap with a first pressure lower than the negative pressure at which the meniscus is broken and, after that, sucks the inside of the cap with a second pressure that is a negative pressure higher than the first pressure.

7. The inkjet printing apparatus according to claim 6, further comprising a leak judgment means which judges leakage of the cap by comparing a pressure value which is a threshold value stored beforehand for leak judgment with a pressure value which is outputted from the pressure sensor.

8. The inkjet printing apparatus according to claim 1, further comprising a leak judgment means which judges leakage of the cap by comparing a pressure value which is a threshold value stored beforehand for leak judgment with a pressure value which is outputted from the pressure sensor.

9. A clogged nozzle recovering method comprising:

a covering step in which some of plural nozzles formed in a nozzle face of a head of an inkjet printer is covered by a cap having a pressure sensor;

a suction step in which an inside of the cap is sucked with a pressure lower than a negative pressure at which a meniscus of a nozzle that is not covered with the cap is broken; and a nozzle recovery judgment step in which recovery of a nozzle is judged by comparing a reference pressure value, which is obtained when a nozzle without being clogged is covered by the cap and sucked and is stored beforehand, with a pressure value which is outputted from the pressure sensor.

10. The clogged nozzle recovering method according to claim 9, further comprising a meniscus breakage pressure acquiring step in which a position and a number of clogged nozzles among all nozzles are acquired, and a position and a number of the clogged nozzles which are not covered with the cap are acquired and, based on the positions and the numbers, a negative pressure at which a meniscus of a nozzle without being clogged which is not covered with the cap is broken is acquired.

11. The clogged nozzle recovering method according to claim 10, wherein, in the suction step, the inside of the cap is sucked with a first pressure lower than the negative pressure at which the meniscus is broken and, after that, the inside of the cap is sucked with a second pressure that is a negative pressure higher than the first pressure.

12. The clogged nozzle recovering method according to claim 11, further comprising a leak judgment step in which leakage of the cap is judged by comparing a pressure value which is a threshold value stored beforehand for leak judgment with a pressure value which is outputted from the pressure sensor.

13. The clogged nozzle recovering method according to claim 10, further comprising a leak judgment step in which leakage of the cap is judged by comparing a pressure value which is a threshold value stored beforehand for leak judgment with a pressure value which is outputted from the pressure sensor.

14. The clogged nozzle recovering method according to claim 9, wherein, in the suction step, the inside of the cap is sucked with a first pressure lower than the negative pressure at which the meniscus is broken and, after that, the inside of the cap is sucked with a second pressure that is a negative pressure higher than the first pressure.

15. The clogged nozzle recovering method according to claim 14, further comprising a leak judgment step in which leakage of the cap is judged by comparing a pressure value which is a threshold value stored beforehand for leak judgment with a pressure value which is outputted from the pressure sensor.

16. The clogged nozzle recovering method according to claim 9, further comprising a leak judgment step in which leakage of the cap is judged by comparing a pressure value which is a threshold value stored beforehand for leak judgment with a pressure value which is outputted from the pressure sensor.

* * * * *